United States Patent [19]

Bost et al.

[11] 4,187,129

[45] Feb. 5, 1980

[54] GELLED MECHANICALLY STABLE HIGH ENERGY FUEL COMPOSITION CONTAINING METAL PLATELETS

[75] Inventors: John J. Bost, Sacramento; Jackie A. Cabeal, Citrus Heights; Sanders D. Rosenberg, West Covina, all of Calif.

[73] Assignee: Aerojet-General Corporation, La Jolla, Calif.

[21] Appl. No.: 195,031

[22] Filed: May 14, 1962

[51] Int. Cl.[2] ..... C06B 45/02; C06B 47/08

[52] U.S. Cl. ..... 149/21; 149/2; 149/36; 149/114

[58] Field of Search ..... 149/17, 36, 2, 21, 114; 60/35.4

[56] References Cited

U.S. PATENT DOCUMENTS 3,077,072 2/1963 Rice ..... 149/36

OTHER PUBLICATIONS

Kit et al., Rocket Propellant Handbook, The MacMillan Company, New York, 1960, pp. 101 to 109.

*Primary Examiner*—Leland A. Sebastian
*Attorney, Agent, or Firm*—John S. Bell

EXEMPLARY CLAIM

1. A gelled mechanically stable high energy fuel composition comprising a hydrazine selected from the group consisting of hydrazine, unsymmetrical dimethyl hydrazine and mixtures thereof and an amount of metal platelets effective to produce a mechanically stable gel, said platelets having a diameter of less than about 44 microns and an average diameter of about 1 micron, and said metal platelets being composed of a metal selected from the group consisting of aluminum, beryllium and aluminum-beryllium alloy.

13 Claims, No Drawings

GELLED MECHANICALLY STABLE HIGH ENERGY FUEL COMPOSITION CONTAINING METAL PLATELETS

This invention relates to a new fuel composition suitable for use in rockets, missiles, and the like.

More specifically this invention relates to gelled liquid hydrazine-type propellants, which offer advantages over neat liquid hydrazine. Fuel compositions containing hydrazine and powdered aluminum are known. However, difficulties have been encountered in preparing gels of hydrazine and powdered aluminum. Heretofore when mixtures of hydrazine and powdered aluminum were allowed to stand, the powdered aluminum tended to settle out unless there was added to the composition an auxiliary gelling agent such as carbon black or silica. Such additives have a low energy content and do not provide fuel value equal to the percent of fuel replaced by the gelling agent; thus, their use has a deleterious effect on the energy value of the total fuel composition.

It is an object of this invention to prepare mechanically stable powdered metal-hydrazine gels which are free of low energy additives such as carbon black and silica. Another object of this invention is to prepare a hydrazine fuel composition containing powdered metals wherein storage stability is achieved by the use of powdered metals in the form of particles having a certain predetermined shape and size. It is also an object of this invention to prepare a thixotropic fuel which can be easily pumped through the nozzles of a rocket engine. In still another aspect of this invention it is an object to prepare gelled hydrazine propellants possessing improved safety because flow from ruptured or perforated tanks or lines is prevented and thus burning of fuels and oxidizers during spills is greatly reduced.

Heretofore, the use of liquid fuels in rockets has presented the problem of sloshing of the fuel within the fuel tanks during the flight. This sloshing can adversely affect the stability of the rocket. Still another object of this invention is to prepare gelled hydrazine propellants which will aid in the operation of liquid rockets through the reduction or elimination of sloshing. It is still another object of this invention to provide a means by which solid additives can be incorporated into hydrazine propellants to increase their specific impulse. A further object of this invention is to provide a high energy fuel composition which possesses a general insensitivity to shock.

It has now been found that a mechanically stable hydrazine gel propellant is obtained upon the incorporation in liquid hydrazine, unsymmetrical dimethyl hydrazine, or mixtures thereof, of an amount of powdered metal platelets effective to produce a mechanically stable gel, said platelets having a particle diameter of less than about 44 microns, as indicated by the fact that substantially all of the platelets will pass through a 325 mesh screen, and having an average particle diameter of about 1 micron. The term "mechanical stability" as used in this case refers to the absence of settling of particulate material in a gelled propellant under normal handling conditions. The amount of platelet metal effective to produce such a mechanically stable gel has been found to be from about 17 parts by weight to about 30 parts by weight of the platelet based on the total weight of the gelled fuel composition.

It is to be understood that in addition to the platelet metal added for purposes of gelation, other additives may be incorporated into the fuel composition to increase the specific impulse. Thus, for example, powdered aluminum in the form of spheres having an average diameter of about 7 microns may be added to increase the specific impulse of the gelled fuel composition.

The preferred metal platelets for use in the practice of our invention are aluminum platelets having the dimensions set forth above. However, the use of platelets of other metal is contemplated. Thus this invention has application to the use of beryllium platelets or to platelets of beryllium-aluminum alloy having the above-mentioned size characteristics.

The preferred platelet aluminum (Platelet A) has, in addition to the above-mentioned characteristics, the following properties:

Screen Retention on 325 Tyler Mesh: 0.1% max.
Moisture Content: 0.1% max.
Bulking Value: 0.047 Gal. per lb.
Weight/solid gallon: 21.4 lbs.

Aluminum platelets having the above-mentioned characteristics are sold by the Reynolds Metals Company under the tradename of Reynolds 40 XD.

The following examples are presented for purposes of illustration only, and should not be regarded as limitative in any way. In the examples the percentages are by weight unless otherwise indicated.

EXAMPLE I

A gelled aluminum hydrazine propellant was prepared by the mixing of 30 parts of Platelet A with 70 parts of commercial hydrazine. The resulting gel was mechanically stable, would not flow under its own weight, and exhibited thixotropic properties under the shear rates produced by rapidly shaking a container filled with the fuel composition.

EXAMPLE II

A gelled aluminum hydrazine fuel was prepared in the following manner:

The aluminum powder was first degassed by heating under vacuum and then being exposed to a nitrogen atmosphere. Twenty parts of the degassed aluminum platelets (Platelet A) were then combined with 13 parts of the degassed aluminum spheres having an average particle diameter of about 7 microns. This aluminum was then added to 67 parts of commercial hydrazine (99.5% pure). Mixing was done in a Waring Blender. The resulting fuel mixture had thixotropic properties as shown by a Brookfield viscometer. This device measures the drag on a spindle as it is passed through the liquid at a specified rate. Brookfield viscometer measurements with a spindle No. 4 at 6 rpm showed that the fuel had a viscosity of 2,200 cp, and at 60 rpm a viscosity of 670 cp. This mixture was found to be mechanically stable as determined by storage tests wherein the gelled product was allowed to stand for 7 days, and no settling out was observed.

When the above procedure was repeated using 15 parts of the degassed platelets (Platelet A), 18 parts of the degassed spheres having an average particle size of about 7 microns and 67 parts of commercial hydrazine, the resulting mixture exhibited thixotropic properties. However, after standing one day, it exuded a liquid phase indicating that it was not mechanically stable. Thus, from the foregoing comparison it can be seen that the amount of platelets used has a critical effect upon the storage stability of the resulting hydrazine fuel composition.

EXAMPLE III

When 23 parts of degassed beryllium platelets having an average particle diameter of about 1 micron and 14 parts of the degassed aluminum spheres having an average particle size of about 7 microns are added to 63 parts of unsymmetrical dimethyl hydrazine in a manner shown in Example II, a storage stable fuel composition is obtained. A mechanically stable fuel composition also results upon the addition of 17 parts of degassed platelets of beryllium-aluminum alloy composed of about 50% by weight of aluminum and about 50% by weight of beryllium, 10 parts of the degassed aluminum spheres, to 73 parts of commercial hydrazine.

In general, as can be seen from the foregoing examples, the stable gels of this invention are produced by mixing the metal platelets with a hydrazine. Normally, the ingredients are effectively blended by shaking or mechanical agitation to deagglomerate the platelets and produce uniform distribution of the platelets throughout the composition.

The gelled fuel compositions of this invention are highly energetic, and therefore are suitable for use as fuel in liquid rocket motors.

The platelets of this invention can be advantageously utilized in other fuels such as liquid hydrogen and pentaborane. Likewise, the metal platelets of this invention may be used to gel other liquid fuel components such as nitric acid.

It will be understood that various modifications may be made in this invention without departing from the spirit thereof or the scope of the appended claims.

We claim:

1. A gelled mechanically stable high energy fuel composition comprising a hydrazine selected from the group consisting of hydrazine, unsymmetrical dimethyl hydrazine and mixtures thereof and an amount of metal platelets effective to produce a mechanically stable gel, said platelets having a diameter of less than about 44 microns and an average diameter of about 1 micron, and said metal platelets being composed of a metal selected from the group consisting of aluminum, beryllium and aluminum-beryllium alloy.

2. A gelled mechanically stable high energy fuel composition comprising a hydrazine selected from the group consisting of hydrazine, unsymmetrical dimethyl hydrazine and mixtures thereof and metal platelets having a particle diameter of less than about 44 microns and an average diameter of about 1 micron, said metal platelets being present in an amount of from about 17 to about 30 parts by weight, based on the total weight of the fuel composition, said metal platelets being composed of a metal selected from the group consisting of aluminum, beryllium and aluminum-beryllium alloy.

3. The composition of claim 2 wherein the hydrazine is a mixture of hydrazine and unsymmetrical dimethyl hydrazine.

4. A gelled mechanically stable high energy fuel composition comprising a hydrazine selected from the group consisting of hydrazine, unsymmetrical dimethyl hydrazine and mixtures thereof and an amount of aluminum platelets effective to produce a mechanically stable gel, said platelets having a diameter of less than about 44 microns and an average diameter of about 1 micron.

5. A gelled mechanically stable high energy fuel composition comprising a hydrazine selected from the group consisting of hydrazine, unsymmetrical dimethyl hydrazine and mixtures thereof and an amount of beryllium platelets effective to produce a mechanically stable gel, said platelets having a diameter of less than about 44 microns and an average diameter of about 1 micron.

6. A gelled mechanically stable high energy fuel composition comprising a hydrazine selected from the group consisting of hydrazine, unsymmetrical dimethyl hydrazine and mixtures thereof and an amount of beryllium-aluminum alloy platelets effective to produce a mechanically stable gel, said platelets having a diameter of less than about 44 microns and an average diameter of about 1 micron.

7. A gelled mechanically stable high energy fuel composition comprising from about 17 to about 23 parts by weight of aluminum platelets having a particle diameter of less than about 44 microns and an average diameter of about 1 micron, from about 10 to about 14 parts by weight of aluminum spheres having an average particle diameter of about 7 microns, and from about 63 to about 73 parts by weight of hydrazine.

8. A gelled mechanically stable high energy fuel composition comprising about 20 parts by weight of aluminum platelets having a particle diameter of less than 44 microns and a particle diameter of about 1 micron, about 13 parts by weight of aluminum spheres having an average particle diameter of about 7 microns, and about 67 parts by weight of hydrazine.

9. The method of preparing a gelled mechanically stable high energy fuel composition which comprises adding to a hydrazine selected from the group consisting of hydrazine, unsymmetrical dimethyl hydrazine and mixtures thereof an amount of metal platelets effective to produce a mechanically stable gel, said platelets having a diameter of less than about 44 microns and an average diameter of about 1 micron, said metal platelets being selected from the group consisting of aluminum, beryllium and aluminum-beryllium alloy; and agitating the mixture to deagglomerate said platelets and produce said gelled fuel composition.

10. The method of preparing a gelled mechanically stable high energy fuel composition which comprises adding to a hydrazine selected from the group consisting of hydrazine, unsymmetrical dimethyl hydrazine and mixtures thereof an amount of aluminum platelets effective to produce a mechanically stable gel, said platelets having a diameter of less than 44 microns and an average diameter of about 1 micron, and agitating the mixture to deagglomerate said platelets and produce said gelled fuel composition.

11. The method of preparing a gelled mechanically stable high energy fuel composition which comprises adding to a hydrazine selected from the group consisting of hydrazine, unsymmetrical dimethyl hydrazine and mixtures thereof an amount of beryllium platelets effective to produce a mechanically stable gel, said platelets having a diameter of less than about 44 microns and an average diameter of about 1 micron, and agitating the mixture to deagglomerate said platelets and produce said gelled fuel composition.

12. The method of preparing a gelled mechanically stable high energy fuel composition which comprises adding to a hydrazine selected from the group consisting of hydrazine, unsymmetrical dimethyl hydrazine and mixtures thereof an amount of aluminum-beryllium alloy platelets effective to produce a mechanically stable gel, said platelets having a diameter of less than about 44 microns and an average diameter of about 1 micron, and agitating the mixture to deagglomerate said platelets and produce said gelled fuel composition.

13. The method of preparing a gelled mechanically stable high energy fuel composition which comprises adding from about 17 to about 23 parts by weight of aluminum platelets having a particle diameter of less than 44 microns and an average diameter of about 1 micron, from about 10 to about 14 parts by weight of aluminum spheres having an average particle diameter of about 7 microns, to about 63 to about 73 parts by weight of hydrazine, and agitating the mixture to deagglomerate said platelets and produce said gelled fuel composition.

* * * * *